US006491546B1

(12) United States Patent
Perry

(10) Patent No.: US 6,491,546 B1
(45) Date of Patent: Dec. 10, 2002

(54) LOCKING F TERMINATOR FOR COAXIAL CABLE SYSTEMS

(75) Inventor: Jason Perry, Newark, DE (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 09/520,749

(22) Filed: Mar. 7, 2000

(51) Int. Cl.[7] ..... H01R 13/66

(52) U.S. Cl. ..... 439/620; 439/133; 439/307; 439/578

(58) Field of Search ..... 439/620, 307, 439/133, 135, 271, 578

(56) References Cited

U.S. PATENT DOCUMENTS

| | | | | |
|---|---|---|---|---|
| 3,362,632 | A | 1/1968 | Scurr et al. | 235/94 |
| 3,519,979 | A | 7/1970 | Bodenstein | 339/85 |
| 3,573,702 | A | 4/1971 | O'Keefe | 338/220 |
| 3,845,454 | A | 10/1974 | Hayward | 339/8 |
| 3,847,463 | A | 11/1974 | Hayward | 338/8 |
| 3,890,028 | A | 6/1975 | Blanchenot | 339/85 |
| 4,145,729 | A | 3/1979 | Hayward | 361/119 |
| 4,400,050 | A | 8/1983 | Hayward | 339/177 |
| 4,469,386 | A | 9/1984 | Ackerman | 339/37 |
| 4,575,274 | A | 3/1986 | Hayward | 403/2 |
| 4,681,390 | A | 7/1987 | Hayward | 439/578 |
| 4,797,121 | A | 1/1989 | Hayward | 439/579 |
| 4,925,403 | A | 5/1990 | Zorzy | 439/578 |
| 5,011,422 | A | 4/1991 | Yeh | 439/307 |
| 5,055,060 | A | 10/1991 | Down et al. | 439/304 |
| 5,106,312 | A | 4/1992 | Yeh | 439/133 |
| 5,141,451 | A | 8/1992 | Down | 439/585 |
| 5,179,877 | A | 1/1993 | Down et al. | 81/443 |
| 5,259,790 | A | 11/1993 | Hayward | 439/578 |
| 5,273,444 | A | 12/1993 | Down et al. | 439/133 |
| D355,641 | S | 2/1995 | Down | D13/151 |
| 5,435,736 | A | 7/1995 | McMills et al. | 439/133 |
| 5,525,076 | A | 6/1996 | Down | 439/585 |
| 5,655,915 | A | 8/1997 | McMills et al. | 439/133 |
| 5,667,405 | A * | 9/1997 | Holliday | 439/271 |

OTHER PUBLICATIONS

Gilbert Engineering Co., Inc., Tools and "F" Series Terminators, Product Brochure, 1998–1999.

* cited by examiner

*Primary Examiner*—Tho D. Ta
(74) *Attorney, Agent, or Firm*—Pennie & Edmonds LLP

(57) ABSTRACT

A tamper-resistant device for terminating a connection to a coaxial cable is provided. The device includes an outer coaxial shell, a threaded connector body housed in the coaxial shell with a snap fit, and a resistor case held within the connector body, and a resistor. A sealing member is included between the resistor case and the connector body to provide a secure seal between these components. The resistor includes a central conductor that is sufficiently durable to avoid being damaged during shipping or installation. The connector body contains slots formed in one end, which permit the device to be installed and removed only with a special tool that is available to cable installers but not to the general public.

39 Claims, 8 Drawing Sheets

LOCKING F TERMINATOR FOR COAXIAL CABLE SYSTEMS

FIELD OF THE INVENTION

This invention relates to devices used to terminate unused cable ports, terminals or the like. The invention is particularly useful for, although not limited to, terminating an unused coaxial cable outlet terminal of the type employed in the cable television industry.

BACKGROUND OF THE INVENTION

Cable antenna television (CATV) systems are conventionally organized so that a communication signal generated at a central antenna can be received by several individual subscribers who are connected to a single coaxial cable that carries the signal. The system functions by connecting devices, such as directional taps, along the cable, and servicing subscribers with a drop line that is connected to one of the devices. Such devices typically have a plurality of output ports so that service can efficiently be provided to many subscribers in the same geographical area. Each of the output ports is usually a female coaxial plug to which the drop line for an individual subscriber is connected.

In many instances, the number of output ports on one of the devices exceeds the actual number of subscribers that are serviced by that device. In such instances, it is desirable to terminate the unused output ports. Termination of the unused output ports serves two principal functions. First, by terminating such output ports with terminators that have impedances selected to match the impedance of the coaxial cable, there is no impedance mismatch between the signal-carrying cable and the active subscriber cables that are connected. Second, the presence of terminators on the unused output ports acts to prevent theft of the cable signal by nonsubscribers who could otherwise simply attach a coaxial cable themselves to any vacant output port. Alternatively, a terminator may be positioned between a previously used output port and the corresponding drop line when the service to that particular subscriber is suspended; in this instance, service can be restored simply by removal of the interposed terminator without requiring that the full wiring to that subscriber be removed.

It is readily apparent that the second of these functions can only be achieved if the terminator is designed so that it is resistant to attempts by unauthorized individuals to remove it after it has been installed. As a result, in the prior art there have been developed terminators that require the use of a special tool that is not available to the general public in order to remove the terminator. An example of such a terminator is described in U.S. Pat. No. 5,055,060 (Down), U.S. Pat. No. 5,179,877 (Down), and U.S. Pat. No. 5,273,444 (Down). In these patents, the terminator is of the type that includes a connector body that is rotatably encapsulated within a shield. This shield contains two ports: one port receives a cable terminal and the other port is used to provide access to a socket in the connector body. This socket is especially adapted to receive a specialized tool that can be used to rotate the connector body within the shield and thereby fasten the terminator to an output port. In such prior-art devices, however, the design for the interaction between the terminator device and the specialized tool often makes the tool difficult to use.

The effectiveness of such a terminator can be judged by a number of different criteria. Such a device should be designed so that the connection of the impedance-matching resistance to the coaxial cable is reliable; in particular, the coaxial post should be sufficiently durable to avoid being damaged either during shipping or installation, and the device should produce a good ground plane when connected. Moreover, the device should preferably have a sealing member that is configured and dimensioned to provide a secure seal of any components within the connector body. Additionally, it should be possible for the device to be installed and removed easily by an authorized individual and resistant to attempts at removal by an unauthorized person.

SUMMARY OF THE INVENTION

The present invention is directed to a tamper-resistant device for terminating a connection. The device comprises a coaxial shell having a first end and a second end; a connector body having a first end and a second end, the connector body being dimensioned and configured to be snap fitted within the coaxial shell and including interior threads disposed at the first end of the connector body adjacent the first end of the coaxial shell; at least one slot in the second end of the connector body for engagement with a cooperating tool to rotate the connector body with respect to the coaxial shell; a resistor case having a first end and a second end, the resistor case mounted within the connector body; and a sealing member between the connector body and the resistor case, the sealing member disposed proximate a portion of the interior threads opposite the first end of the connector body and gripping at least a portion of the first end of the resistor case.

In a preferred embodiment, at least a portion of an outer surface of the second end of the coaxial shell is threaded. Also, the coaxial shell and the connector body are cylindrically symmetric about a longitudinal axis, the inner diameter of the second end of the coaxial shell being substantially equal to the inner diameter of the second end of the connector body. The second end of the connector body preferably includes two slots. Further, the second end of the resistor case includes a cylindrical hole and a frustoconical bevel. The device further comprises a resistor mounted within the resistor case for electrical connection to the coaxial output port. The resistor preferably comprises a central conductor and a body. The impedance of the resistor is preferably about 75 Ω.

In the embodiment where the device comprises a resistor with a central conductor and a body, and is mounted with the resistor case for electrical connection to the coaxial output port, there are several preferred features of the device. The central conductor preferably extends through the hole in the resistor case, and is mounted within the resistor case by solder filled in a frustum-shaped cavity defined by the frustoconical bevel. The diameter of the central conductor is preferably between about 0.029 and about 0.035 inches. Most preferably, the diameter of the central conductor is substantially equal to about 0.032 inches. The resistor case is also preferably press fitted to the connector body. Further, the resistor case preferably comprises an annularly shaped ground plane. The outside diameter of the annularly shaped ground plane is preferably greater than 0.280 inches. In one embodiment of the invention, the outside diameter of the annularly shaped ground plane is substantially equal to about 0.281 inches and the inside diameter of the annularly shaped ground plane is substantially equal to about 0.210 inches.

The resistor case may be composed of metal. In a preferred embodiment, the resistor case is composed of brass and is plated with a material selected from the group consisting of nickel and tin. In one embodiment, the connector body is also composed of metal. Where the connector body is composed of metal, it is preferably composed of brass. In another embodiment, the connector body is composed of plastic. Where the connector body is composed of plastic, the connector body is preferably composed of a material selected from the group consisting of Ultem™ and glass-filled polycarbonate. The coaxial shell may also be composed of metal. Where the coaxial shell is composed of metal, it is preferably composed of brass. In a different embodiment, the coaxial shell is composed of plastic. Where the coaxial shell is composed of plastic, it is preferably composed of a material selected from the group consisting of Ultem™ and glass-filled polycarbonate. The sealing member is preferably composed of silicone rubber.

The invention is also directed to a tamper-resistant device for terminating a connection comprising a coaxial shell having a first end and a second end; a connector body having a first end and a second end, the connector body being dimensioned and configured to be snap fitted within the coaxial shell and including interior threads disposed at the first end of the connector body adjacent the first end of the coaxial shell, the connector body further including two slots in its second end for engagement with a cooperating tool to rotate the connector body with respect to the coaxial shell; a resistor case having a first end and a second end, the resistor case being dimensioned and configured to be mounted within the connector body; a resistor mounted within the resistor case for electrical connection to the coaxial output port; and a sealing member between the connector body and the resistor case, the sealing member disposed proximate a portion of the interior threads opposite the first end of the connector body and gripping at least a portion of the first end of the resistor case. In a preferred embodiment, the resistor comprises a central conductor with a diameter between about 0.029 and about 0.035 inches. The central conductor most preferably has a diameter substantially equal to 0.032 inches. The resistor case also comprises an annularly shaped ground plane with an outside diameter greater than 0.280 inches. Preferably, the inside diameter of the annularly shaped ground plane is substantially equal to about 0.210 inches. In one embodiment, the coaxial shell is composed of brass, the connector body is composed of brass, and the resistor case is composed of brass plated with nickel.

The invention is further directed to a tamper-resistant device for terminating a connection comprising a coaxial shell; a connector body having a first end and a second end, the connector body being housed within the coaxial shell and including interior threads, the interior threads disposed at the first end of the connector body; and a resistor mounted within the connector body, the resistor comprising a central conductor and a body, the central conductor having a diameter between about 0.029 and about 0.035 inches. Preferably, the central conductor has a diameter substantially equal to about 0.032 inches.

The invention is additionally directed to a tamper-resistant device for terminating a connection comprising a coaxial shell having a first end and a second end; a connector body having a first end and a second end, the connector body being dimensioned and configured to be snap fitted within the coaxial shell and including interior threads disposed at the first end of the connector body adjacent the first end of the coaxial shell, the connector body further including two slots in its second end for engagement with a cooperating tool to rotate the connector body with respect to the coaxial shell; a resistor case having a first end and a second end, the resistor case being dimensioned and configured to be mounted within the connector body, the resistor case comprising an annularly shaped ground plane with an outside diameter greater than 0.280 inches; a resistor mounted within the resistor case for electrical connection to the coaxial output port, the resistor comprising a central connector and a body, the central conductor having a diameter between about 0.029 and about 0.035 inches; and a sealing member between the connector body and the resistor case, the sealing member disposed proximate a portion of the interior threads opposite the first end of the connector body and gripping at least a portion of the first end of the resist or case. Preferably, the central conductor has a diameter substantially equal to about 0.032 inches. Also, the inside diameter of the annularly shaped ground plane is preferably substantially equal to about 0.210 inches. In one embodiment, the coaxial shell is composed of brass, the connector body is composed of brass, and the resistor case is composed of brass plated with nickel.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE INVENTION

In the description which follows, any reference to either direction or orientation is intended primarily and solely for purposes of illustration and is not intended in any way as a limitation on the scope of the present invention. Also, the particular embodiments described herein, although being preferred, are not to be considered as limiting of the present invention. Furthermore, like parts or elements in the various drawings hereto are identified by like numerals for ease of reference.

Figure 1:
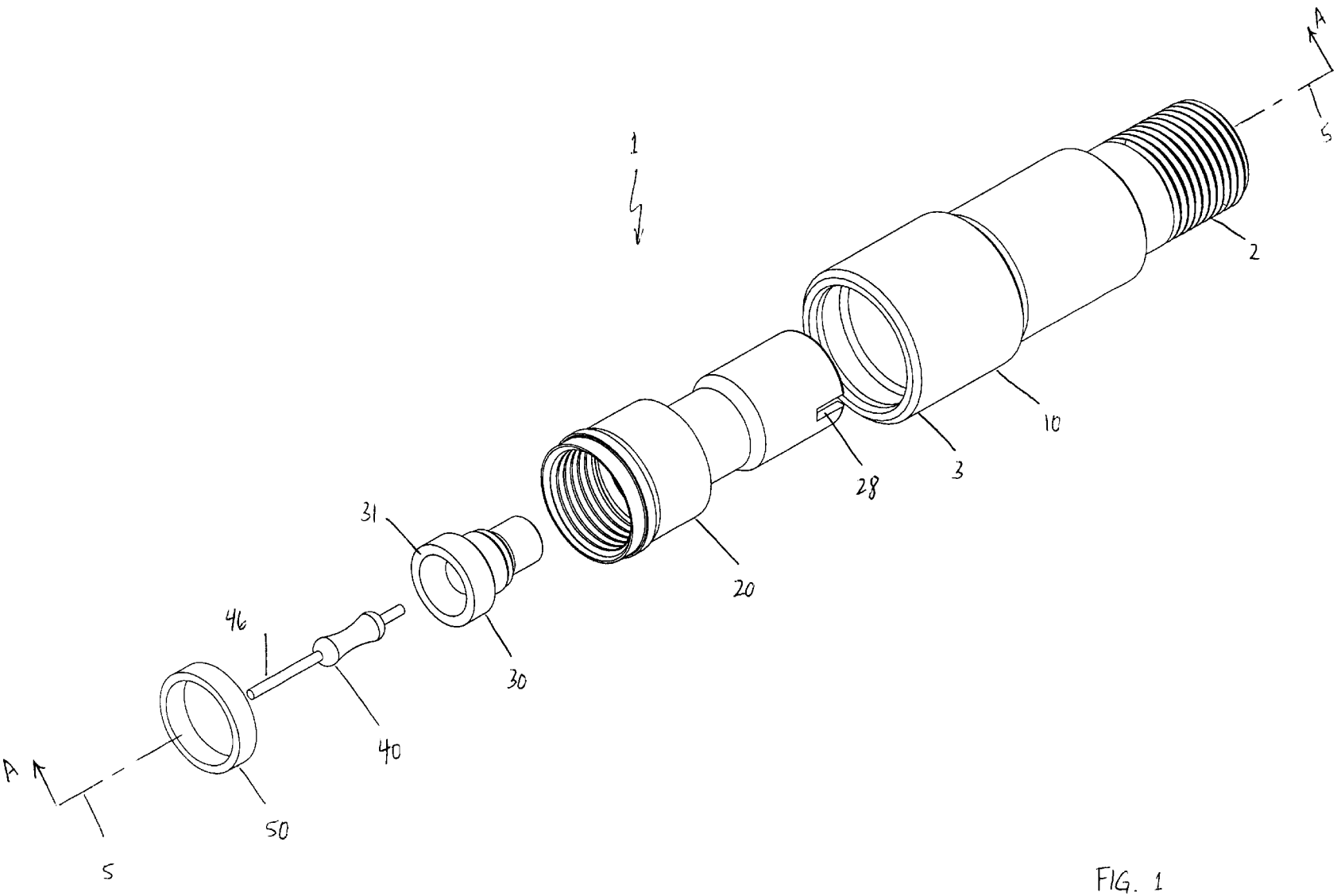
FIG. 1 shows an exploded perspective view of the tamper-resistant terminator device of the present invention.

Attention is first directed to FIG. 1, which illustrates the overall structure of the terminator device 1 with an exploded perspective view of its principal parts. The terminator 1 of this invention includes a connector body 20 that is rotatably contained within a coaxial shell 10. The connector body 20 is preferably snap fitted within the coaxial shell 10 so that the connector body 20 may rotate freely therein. A resistor case 30 is housed within the interior of the connector body 20 and holds a resistor 40. The resistor case 30 can be fixed in position within the connector body 20 by a press fit. A sealing member 50 is preferably provided to seal the clearance between the resistor case 30 and the connector body 20 when the terminator 1 is assembled.

These five principal parts are connected together along longitudinal axis 5 so that the assembled terminator 1 is open at both ends. At the second end 2 of the assembled terminator 1, a chamber is formed through which the terminator 1 can receive a specialized installation tool 60 (shown in FIG. 7) that can be used for installation and removal of the terminator 1 onto and off of an output port (not shown) at its first end 3. At the first end 3 of the terminator 1, the first end 46 of the central conductor of the resistor 40 protrudes from the resistor case 40 and acts as the coaxial post for insertion into the signal output hole of the output port (not shown). The configuration of the coaxial post can be seen in FIG. 6, which shows a longitudinal cross section of the assembled device.

The structure of each of the principal parts of the terminator 1 is now generally described in greater detail with reference to FIGS. 2–5. Although each of the parts is described with reference to these individual figures, the reader may find it helpful also to refer simultaneously to FIG. 6, which shows how the different components interact when the device is assembled.

Figure 2:
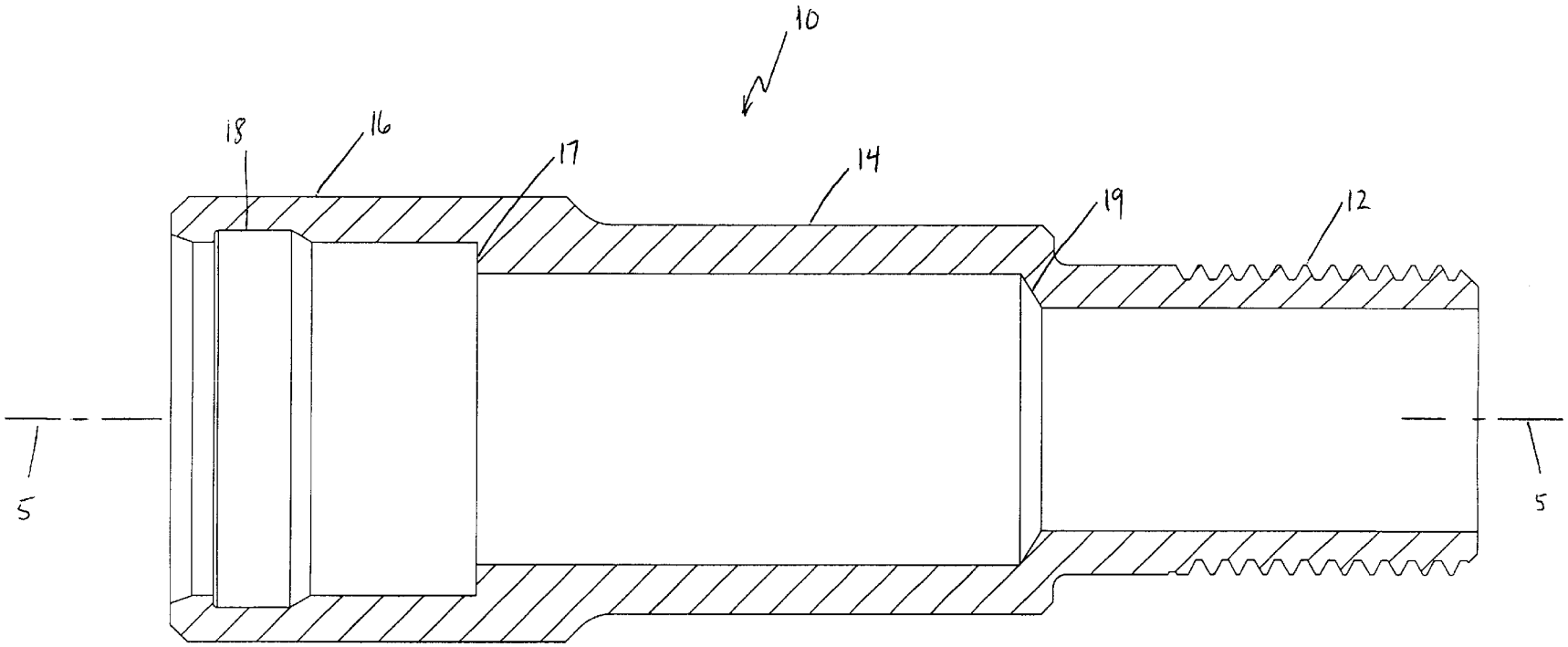
FIG. 2 shows a longitudinal cross-sectional elevation of the coaxial shell of the tamper-resistant terminator device, the elevation being taken along line A—A of FIG. 1.

FIG. 2 shows a cross-sectional view of the coaxial shell 10. The coaxial shell 10 is cylindrically symmetric about longitudinal axis 5 and includes three distinct sections with different internal diameters. The external portion of the second section 12 of the coaxial shell 10 is threaded. This threading permits the terminator 1 to be readily used in two different circumstances. In the first instance, the output port to be terminated has never been used by any subscriber. The terminator 1 may be attached to such a vacant output port, and (while not preferred) closed with a threaded cap that is screwed onto the threaded second section 12 of the coaxial shell 10.

In the second instance, the output port has previously been wired for connection of cable service to a subscriber. If service to the subscriber is to be suspended, either because of cancellation of service by the subscriber or because of nonpayment of subscription fees, the terminator 1 may be interposed between the output port and the drop line that is connected to that subscriber. This is done by screwing the coaxial drop line onto the threaded second section 12 of the coaxial shell 10. In order to accommodate this type of usage, the interior of the second section 12 of the coaxial shell 10 must be sufficiently deep to contain the coaxial post of the drop line that is attached to it. In the event that service to that subscriber is subsequently to be reestablished, it is simply necessary to remove the terminator 1 and reestablish the connection between the output port and the drop line. The threading of the second section 12 of coaxial shell 10 thus makes it possible to suspend service temporarily without necessitating any extensive wiring changes to a subscriber.

Figure 6:
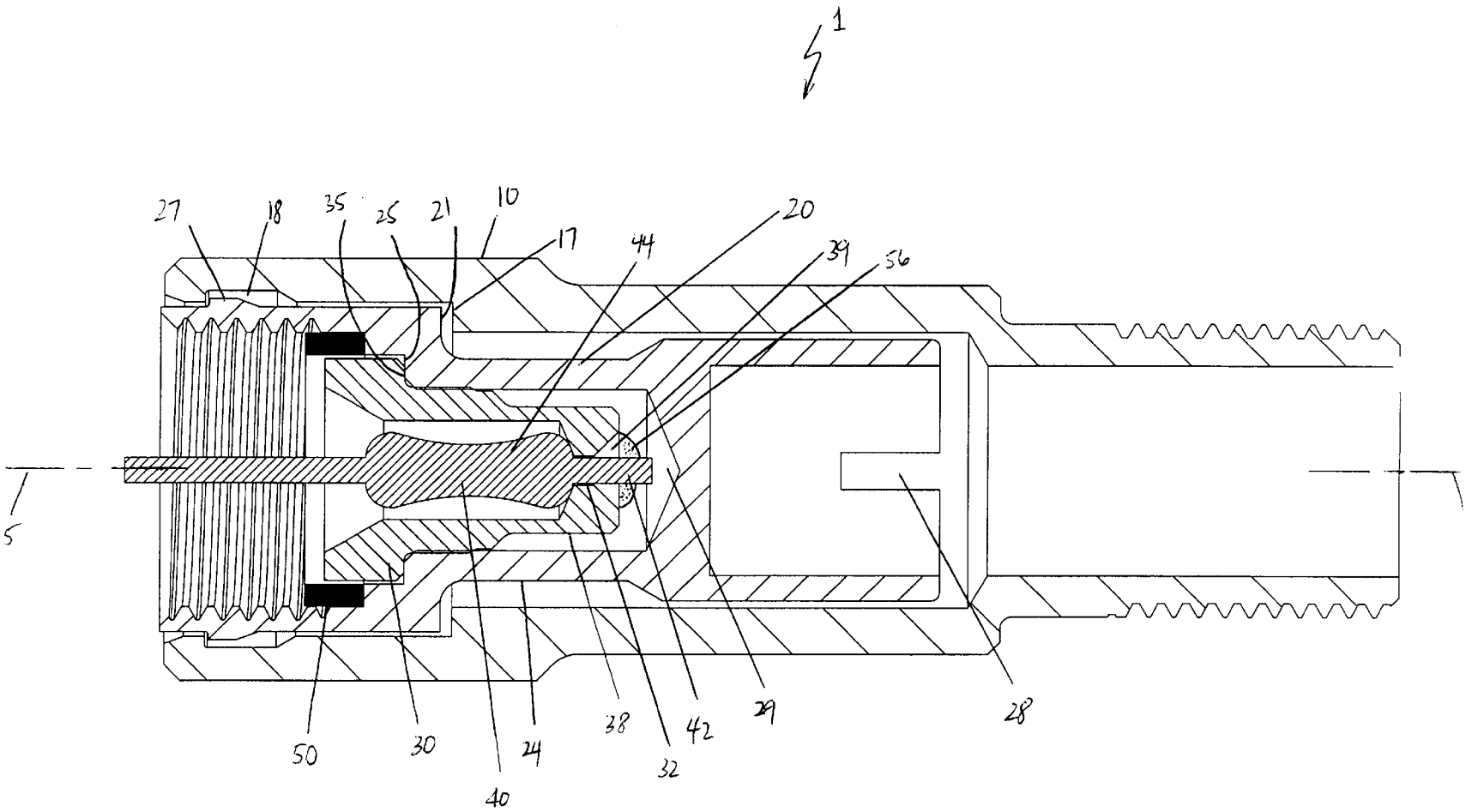
FIG. 6 shows a longitudinal cross-sectional elevation of the assembled tamper-resistant terminator device, the elevation being taken along line A—A of FIG. 1.

The intermediate section 14 of the coaxial shell 10 has an interior diameter that is greater than the interior diameter of the second section 12. Similarly, the first section 16 of the coaxial shell 10 has an interior diameter that is greater than the interior diameter of the intermediate section 14. Flange 17 is formed as part of the transition between the intermediate section 14 and the first section 16 of the coaxial shell 10; flange 17 is useful in restricting the longitudinal motion of the connector body 20 when the device is assembled. Additionally, a surface 19 is formed as part of the transition between the intermediate section 14 and the second section 12 of the coaxial shell 10. This surface 19 also restricts the longitudinal motion of the connector body 20, in this case by preventing the connector body 20 from moving into the second section 12 of the coaxial shell 10. When the terminator 1 is assembled as shown in FIG. 6, the connector body 20 is housed within the first 16 and intermediate 14 sections of the coaxial shell 10. In a preferred embodiment of the invention, the interior of the first section 16 contains a groove 18, which functions with the circumferential protrusion 27 on connector body 20, as described below with reference to FIG. 3, to provide for a snap fit between the connector body 20 and the coaxial shell 10 when the terminator 1 is assembled. In an alternative embodiment of the invention, the snap fit may be provided instead with a groove in the exterior of the connector body 20 and a protrusion on the interior of the coaxial shell 10.

The coaxial shell 10 can be constructed of a material that is sufficiently strong that it can be snap fitted as described above with respect to the assembly of the terminator 1. Also, the coaxial shell can be sufficiently durable that it is resistant to tampering, which may include crushing, pulling, bending, and striking. It is preferable that the coaxial shell 10 be resistant to tampering because it is the external part of the device that houses the other internal components. In a preferred embodiment, it is constructed of metal. In a particular embodiment of the invention, this metal is brass. In other embodiments of the invention, for example, the coaxial shell is composed of a durable plastic such as Ultem™ or glass-filled polycarbonate.

Figure 3:
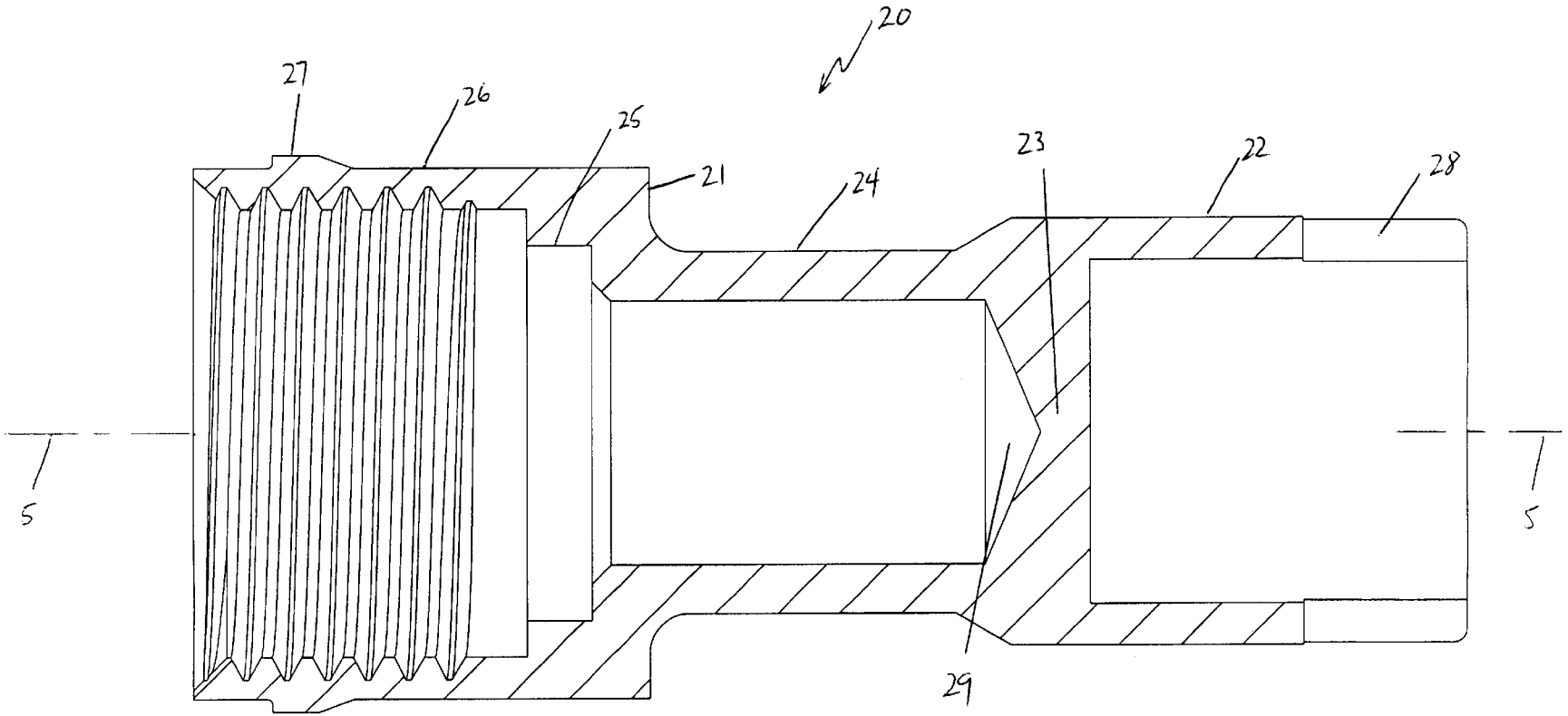
FIG. 3 shows a longitudinal cross-sectional elevation of the connector body of the tamper-resistant terminator device, the elevation being taken along line A—A of FIG. 1.

A cross sectional view of the connector body 20 is illustrated in FIG. 3. The connector body 20 is also cylindrically symmetric (except for slots 28 shown in perspective view in FIG. 1) about longitudinal axis 5 and also has three distinct sections. As mentioned above, the lengths of the sections of the connector body 20 should be such that it can be housed within the first 16 and intermediate 14 sections of the coaxial shell 10, where the physical constraints provided by flange 17 and surface 19 within the coaxial shell 10 prevent substantial longitudinal motion of the connector body 20.

Figure 7:
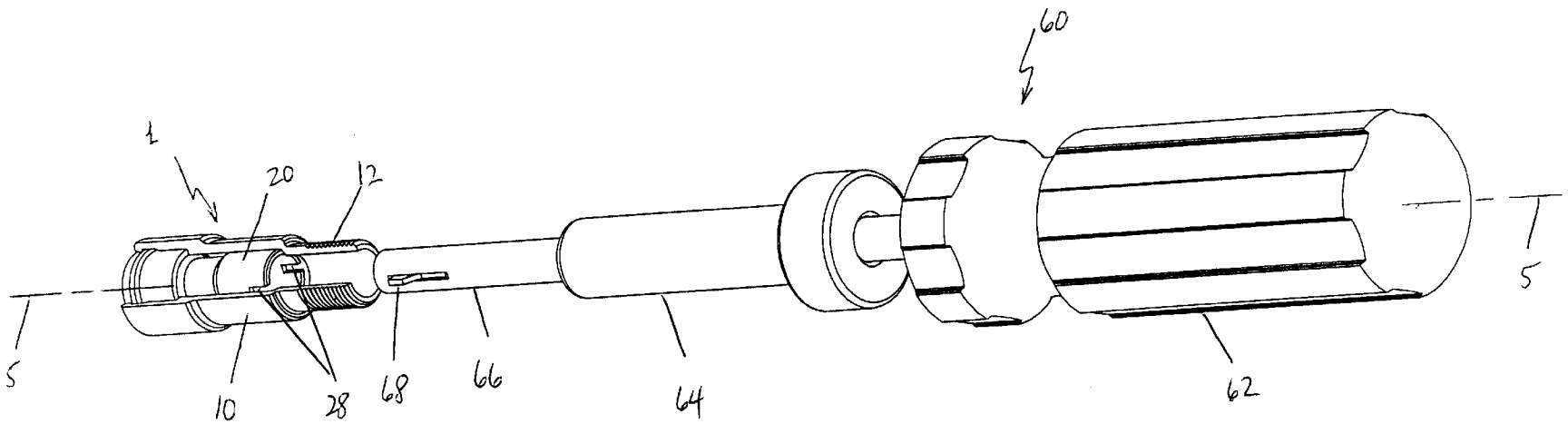
FIG. 7 illustrates the use of the specialized installation and removal tool with a perspective view of the tool and a fragmentary perspective view of the assembled tamper-resistant terminator device.

The second section 22 of the connector body 20 is configured and dimensioned to accept an insertion tool 60 (shown in FIG. 7). As is described in greater detail below, tabs on a shaft of the insertion tool engage slots 28 (shown also in FIG. 1) in the second section 22 of the connector body 20 in order to rotate the connector body 20. The interior diameter of the second section 22 of the connector body 20 is thus preferably the same as the interior diameter of the second section 12 of the coaxial shell 10; in this instance, the second section 12 of the coaxial shell 10 and the second section 22 of the connector body 20 together form a chamber that allows for easy insertion of the shaft of the tool 60.

The first section 26 of the connector body 20 contains an interior thread for connection with a coaxial cable output port (not shown). The intermediate section 24 of the connector body 20 has an interior diameter that snugly accommodates the resistor case 30 (shown in FIG. 4) when the terminator 1 is assembled. Additionally, the interior of the first section 26 of the connector body 20 narrows at the connection to the intermediate section 24 of the connector body 20 in a lip 25, which is used to secure the resistor case 30 more firmly. There is a similar outside surface 21 at the transition between the first section 26 of the connector body 20 and the intermediate section 24 of the connector body 20; this surface 21 interacts with flange 17 inside the coaxial shell 10 as described above to hold the connector body 20 in place inside the coaxial shell 10.

The connector body 20 is preferably constructed of metal. In a preferred embodiment, the metal is brass. The terminator device 1 may still function if the connector body 20 is constructed of another material, provided that material is sufficiently strong for the snap fit with the coaxial shell 10, as described above, to remain intact, and for the slots 28 to remain undamaged by use of the tool 60. Suitable nonmetallic materials that may be used in the construction of the connector body include Ultem™ and glass-filled polycarbonate.

In a preferred embodiment of the invention, there is no open internal communication between the intermediate 24 and second 22 sections of the connector body 20, which are instead separated by a wall 23. The existence of the wall 23 ensures that when the terminator 1 is assembled and attached to an output port there is some additional protection of the resistor 40 (shown in FIG. 5). In another preferred embodiment of the invention, the wall 23 is beveled on the side of the intermediate section 24 to create a recess 29; the presence of this recess 29 serves to lessen any possibility that the second end 42 of the central conductor of the resistor 40 (not shown in FIG. 3) will be pressed against wall 23 when the terminator 1 is assembled. In yet another preferred embodiment of the invention, the exterior of the first section 26 contains a circumferential protrusion 27, which is positioned so that it will interlock with internal groove 18 in the coaxial shell 10 as part of the snap fit that holds the connector body 20 within the coaxial shell 10.

Figure 4:
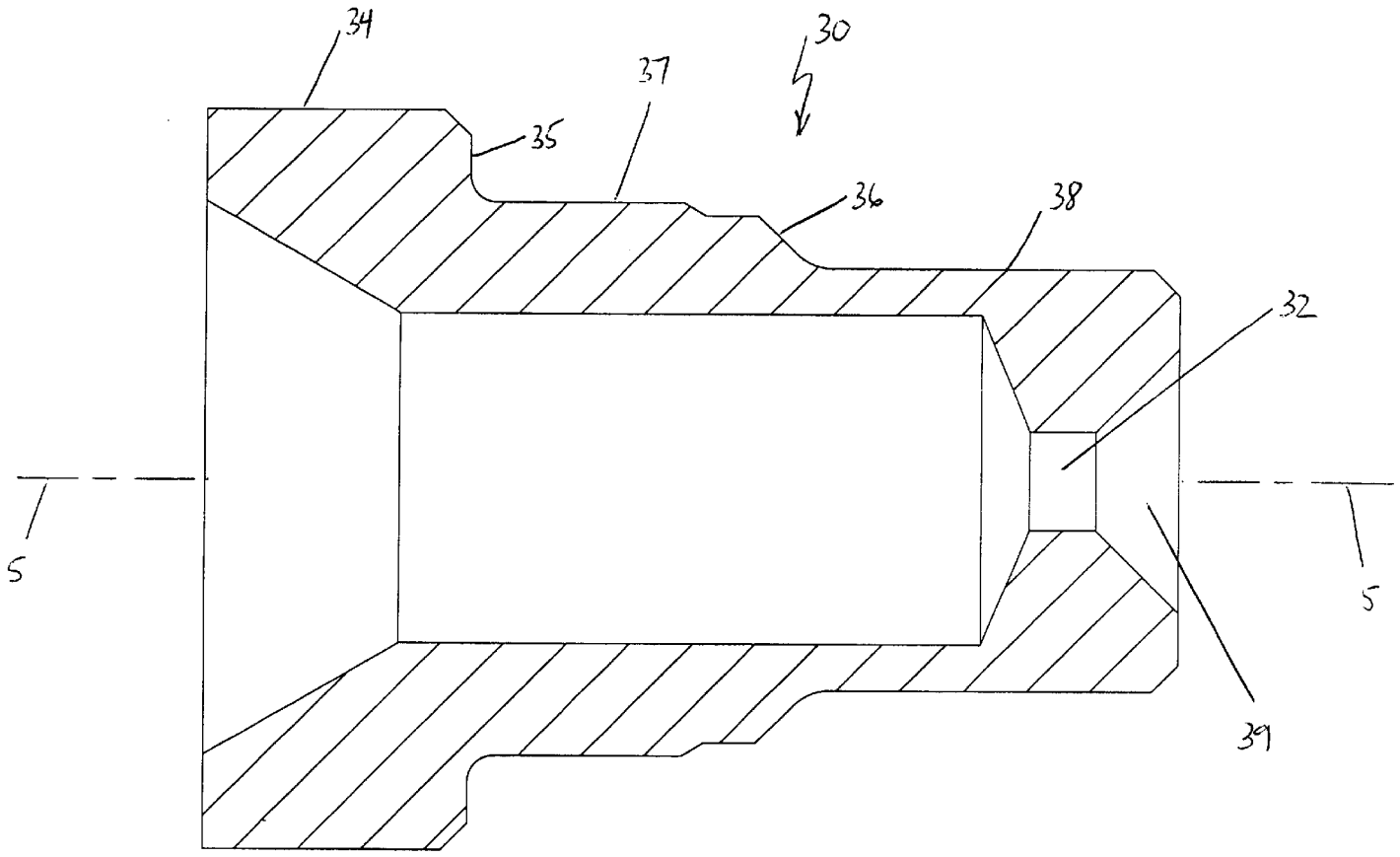
FIG. 4 shows a longitudinal cross-sectional elevation of the resistor case of the tamper-resistant terminator device, the elevation being taken along line A—A of FIG. 1.

The resistor case 30 is shown in FIG. 4 in a cross sectional view. The resistor case 30 is also cylindrically symmetric about longitudinal axis 5 and functions primarily to house and protect the resistor 40 (shown in FIG. 5). The resistor case 30 includes a hole 32 at its second end 38, through which the second end 42 of the resistor 40 may protrude when the terminator 1 is assembled. The second end 38 of the resistor case 30 can also include a frustoconical bevel that extends from hole 32, so as to produce a frustum-shaped cavity 39 that may be filled with solder to hold the resistor 40 in place when the terminator 1 is assembled. The first end 34 of the resistor case 30 can have an external diameter such that it will be held firmly in place in the connector body 20 when surrounded by the deformable sealing member 50 (shown in FIG. 1).

The first end 34 of the resistor case 30 should be of appropriate length to position the resistor case 30 within the connector body 20. Specifically, edge 35 of the first end 34 should rest against the lip 25 of the interior of the connector body 20. This configuration will assist in maintaining the proper position for the resistor case 30 within the connector body 20 when the terminator is assembled, as described below. Additionally, the intermediate section 37 of the resistor case 30 has an outer diameter that is substantially similar to the inner diameter of the intermediate section 24 of the connector body 20. This allows the resistor case 30 to be held firmly in place in the connector body 20 when assembled.

In a preferred embodiment of the invention, the outer diameter of the intermediate section 37 of the resistor case 30 is slightly greater than the inner diameter of the intermediate section 24 of the connector body 20. In this embodiment, there is some deformation of the resistor case 30 and the connector body 20 along the circumference where they are snap fit together, providing a very secure fit. The outer diameter of the resistor case 30 is also preferably beveled at surface 36 so that the second section 38 of the resistor case 30 is narrower than the internal diameter of the intermediate section 24 of the connector body 20. When the terminator is assembled, the free space thus formed between the connector body 20 and the resistor case 30 in this region may be filled with solder, thereby bonding the resistor case 30 in position with even greater durability.

As will be appreciated by those of skill in the art, the resistor case 30 must be constructed from a material that is electrically conductive so as to create an electrical connection with the resistor 40 when the terminator 1 is assembled. Preferably, the resistor case 30 is also plated with a material that is solderable. Suitable solderable plating materials include nickel and tin. As described above, this then permits the resistor case 30 to be soldered in place within the connector body 20 when assembled, providing a more secure fit between the two parts. In a preferred embodiment, the resistor case 30 is constructed of brass and is plated with nickel.

Figure 5:
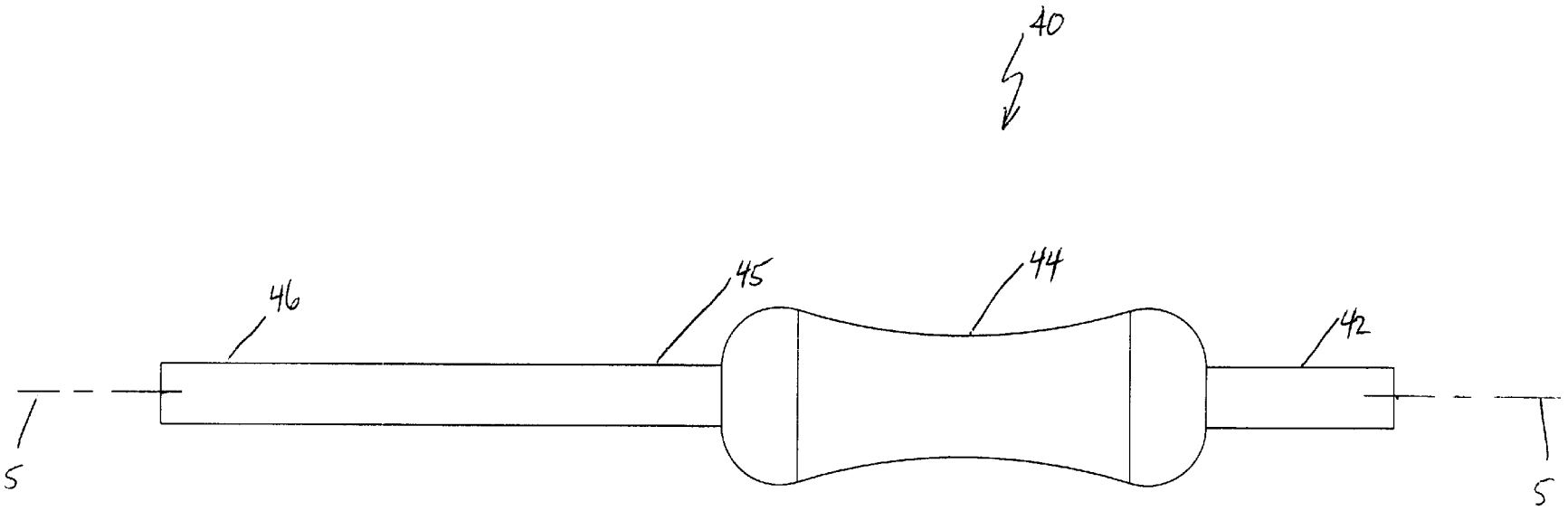
FIG. 5 shows a longitudinal cross-sectional elevation of the resistor used in the tamper-resistant terminator device, the elevation being taken along line A—A of FIG. 1.

A cross sectional view of the resistor 40 is shown in FIG. 5. In the preferred embodiment, the resistor is a carbon-film 75-Ω¼-watt resistor. The resistor has a body 44 and a central conductor 45. The central conductor 45 has a second end 42, which is held within the resistor case 30, and a first end 46, which protrudes from the terminator 1 when assembled, and acts as the coaxial post for the terminator. This coaxial post is inserted into the output port that is to be terminated when the connection is made.

The sealing member 50, which is illustrated in perspective view in FIG. 1, is constructed as a ring that can be positioned between the connector body 20 and the resistor case 30. The sealing member 50 should be made of a deformable material so that it may be deformed when positioned between the connector body 20 and the resistor case 30, thereby sealing the gap between the two. Advantageously, the sealing member 50 is positioned proximate a portion of the interior threads opposite the first end of the connector body 20 at a position where it grips at least a portion of the first end 34 of the resistor case 30. This location ensures a secure seal. A preferred material for the sealing member 50 is silicone rubber.

The assembled terminator 1 is shown in cross-sectional view in FIG. 6. As is readily apparent from the figure, the individual components are placed so that the terminator is cylindrically symmetric about longitudinal axis 5, with the exception of the slots 28. The connector body 20 is housed within the coaxial shield 10. As noted previously above, the connector body 20 is held within the coaxial shield 10 with a snap fit formed between the cylindrical protrusion 27 formed on the exterior of the connector body 20 and the groove 18 formed in the interior surface of the coaxial shield 10. Any longitudinal motion of the connector body 20 within the coaxial shield 10 is additionally restricted by the interaction of flange 17 with surface 21.

Similarly, the resistor case 30 is housed within the connector body 20. The resistor case 30 may be held firmly in place within the connector body 20 by a press fit. Longitudinal motion of the resistor case 30 may be restricted by the abutment of edge 35 of the resistor case 30 against lip 25 of the connector body 20. In another embodiment of the invention, the resistor case 30 may be held in place by soldering the second section 38 into the intermediate section 24 of the connector body 20. In yet another embodiment, the resistor 30 can be mounted in the connector body 20 without the use of resistor case 30.

The resistor 40 is held within the resistor case 30 by securing the second end 42 of central conductor of the resistor 40 within hole 32 of the resistor case 30. The body 44 of the resistor 40 is preferably pressed flush against the inside of the resistor case 30 so that the second end 42 of the central conductor of the resistor 40 protrudes fully through hole 32 and into recess 29 of the connector body 20. In this position, the frustum-shaped cavity 39 is filled with solder and a cap of solder 56 is formed over the protruding portion of the second end 42 of the central conductor of the resistor 40 so that the resistor 40 is affixed securely within the resistor case 30.

Installation and removal of the assembled terminator 1 on or from an output port requires a specialized tool 60, which is illustrated in a perspective view in FIG. 7. The specialized tool 60 is of a type known in the prior art, such as GTT-7 available from CablePro. Such tools are commercially available to cable installers but not to the general public. Such unavailability should prevent its unauthorized removal once the terminator is installed. The tool consists of a handle 62, a tab actuator 64, a shaft 66, and a pair of retractable tabs 68. The diameter of the shaft 66 is less than the inside diameter of the threaded second end 12 of the coaxial shell 10, so that the shaft 66 may be inserted into the chamber formed by the coaxial shell 10 and the connector body 20.

When used, the tool 60 is positioned so that it is cylindrically symmetric about longitudinal axis 5, and the tab actuator 64 may then be moved in this longitudinal direction to engage or disengage the retractable tabs 68. When the tabs 68 are retracted within the shaft 66, the shaft 66 may be easily inserted into the chamber formed by the coaxial shell 10 and the connector body 20. Once the shaft 66 has been inserted into the chamber, the retractable tabs 68 are released and locked into the slots 28. The tool operator may then transmit torque to the connector body 20 by rotating the tool 60 so that the threaded first section 26 of the connector body 20 is screwed onto or off of an output port depending on the direction of rotation. Once the terminator 1 is installed or removed from the output port, the tabs 68 are again retracted within the shaft 66 by using the tab actuator 64, and the shaft 66 is removed from within the chamber in the terminator 1. It will be readily appreciated that the number of retractable tabs 68 is preferably equal to the number of slots 28 in the connector body 20.

Figure 8:
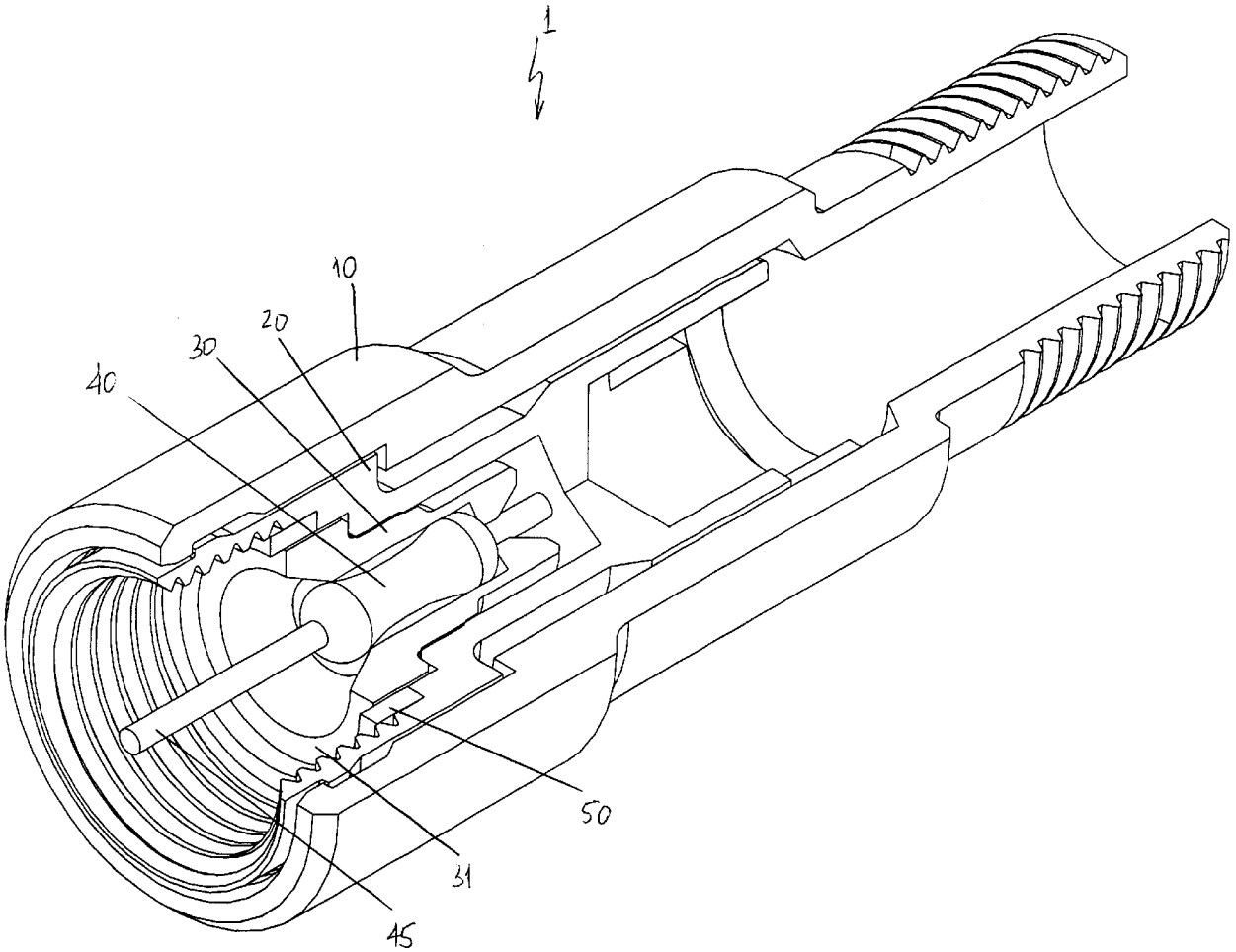
FIG. 8 illustrates the assembled tamper-resistant terminator device with a fragmentary perspective view, including the ground plane that is required for the electrical connection of the terminator device.

A cutaway perspective view of the assembled terminator 1 is illustrated in FIG. 8. In this figure, the positioning of the various components with respect to each other is clearly shown: the resistor 40 is housed within the resistor case 30, which is in turn housed within the internally threaded connector body 20, which is itself housed within the coaxial shell 10. Of particular note in this figure is the positioning of the sealing member 50, which is compressed between the first end of the connector body 20 and the first end of the resistor case 30 at a point proximate a portion of the interior threads opposite the first end of the connector body 20. The figure also displays the configuration of the ground plane, which is defined by the face 31 of the resistor case 30 and which is shaded in the figure. An alternative view of the face 31 of the resistor case 30 is shown in FIG. 1 for the exploded view of the terminator.

As will be appreciated by those of skill in the art, both the central conductor 45 of the resistor 40, acting as the coaxial post, and the ground plane, as defined by the face 31 of the resistor case 30, are of importance in the electrical functioning of the terminator 1 when it is installed. The face 31 of the resistor case 30 is fabricated of an electrically conductive material, as is the entire resistor case 30. When the terminator 1 is installed, the central conductor 45 of the resistor 40 is inserted into the coaxial cable and the face 31 of the resistor case 30 is pressed against a metallic grounded plate (not shown). The electrical circuit is formed, first, by the electrical connection between the central conductor 45 of the resistor 40 and the conductive resistor case 30 and, second, by the electrical connection between the resistor case 30 and the metallic grounded plate through the face 31 of the resistor case 30 as defined by the ground plane. As a result of this electrical connection, the resistor 40, which has been selected to have a resistance that matches the 75-Ω impedance of the coaxial cable, is used to terminate an unused output port. By housing the resistor 40 in the terminator 1 as described above, such an impedance matching terminating connection can thus be made in a tamper-resistant manner.

It will thus also be readily appreciated by those of skill in the art that the effectiveness of the terminator device 1 can be evaluated with respect to two criteria: first, the reliability of the electrical connection through the resistor 40; second, the reliability of the tamper-resistant features of the device. With respect to the first criterion, the reliability of the electrical connection is dependent on (1) the strength of the central conductor 45 of the resistor 40 so that it does not collapse during field installation nor bend in packaging during shipping, and (2) the integrity of the electrical connection at the ground plane. Advantageously, in the preferred embodiment of the invention, the central conductor 45 has a diameter between about 0.029 and about 0.035 inches. This is larger than previously known in the prior art and provides sufficient strength for the central conductor 45 to avoid inadvertent collapsing or bending. The diameter of the central conductor 45 is most preferably substantially equal to about 0.032 inches. Also in the preferred embodiment of the invention, the outer diameter of the first section 34 of the resistor case 30, which corresponds to the outer diameter of the ground plane, is substantially equal to about 0.281 inches, which exceeds the minimum standard of 0.280 inches established by the Society of Cable Telecommunications Engineers (SCTE). The inner diameter of the face 31 of the resistor case 30, which corresponds to the inner diameter of the ground plane, is preferably substantially equal to about 0.210 inches.

With respect to the second criterion, the reliability of the tamper-resistant features of the terminator device 1 are dependent on the ease with which the device may be installed or removed when an operator is equipped with the specialized tool 60 and the difficulty with which an unauthorized individual who does not possess the specialized tool 60 will be faced in attempting to remove the device. The configuration of the components in the device as described above makes the authorized installation and removal of the terminator 1 less complicated than was known in the prior art. By inserting the retractable tabs 68 into the slots 28 of the connector body 20, it is simple to transmit the necessary torque to install or remove the device. The resistance of the device to unauthorized tampering is also clearly dependent on the durability of the materials used. In a preferred embodiment of the invention, all of the resistor case 30, the connector body 20, and the coaxial shield 10 are fabricated of metal to ensure that this durability is high.

While the present invention has been described and illustrated herein with respect to the preferred embodiments, it should be apparent that various modifications, adaptations and variations may be made utilizing the teachings of the present disclosure without departing from the scope of the invention and are intended to be within the scope of the present invention.

What is claimed is:

1. A tamper-resistant device for terminating a connection comprising:

a coaxial shell having a first end and a second end;

a connector body having a first end and a second end, the connector body being dimensioned and configured to be snap fitted within the coaxial shell and including interior threads disposed at the first end of the connector body adjacent the first end of the coaxial shell;

at least one slot in the second end of the connector body for engagement with a cooperating tool to rotate the connector body with respect to the coaxial shell such at least one slot extending from the outside of the connector body to the inside of the connector body;

a resistor case having a first end and a second end, the resistor case being dimensioned and configured to be mounted within the connector body; and a sealing member between the connector body and the resistor case, the sealing member disposed proximate a portion of the interior threads opposite the first end of the connector body and gripping at least a portion of the first end of the resistor case.

2. The device of claim 1, wherein at least a portion of an outer surface of the second end of the coaxial shell is threaded.

3. The device of claim 1, wherein the coaxial shell and the connector body are cylindrically symmetric about a longitudinal axis, the inner diameter of the second end of the coaxial shell being substantially equal to the inner diameter of the second end of the connector body.

4. The device of claim 1, wherein the second end of the connector body includes two slots.

5. The device of claim 1, wherein the resistor case is cylindrically symmetric about a longitudinal axis, the second end of the resistor case including a cylindrical hole and a frustoconical bevel.

6. The device of claim 1 including a tool having a retractable tab for insertion in at least a slot.

7. The device of claim 1, further comprising a resister mounted within the resistor case for electrical connection through the second end of the coaxial shell.

8. The device of claim 7, wherein the resistor comprises a central conductor and a body.

9. The device of claim 8, wherein the resistor has an impedance of about 75 Ω.

10. The device of claim 8, wherein the central conductor extends through the hole in the resistor case, and is mounted within the resistor case by solder filled in a frustum-shaped cavity defined by the frustoconical bevel.

11. The device of claim 8, wherein the resistor case is soldered to the connector body.

12. The device of claim 8, wherein the sealing member is composed of silicone rubber.

13. The device of claim 8, wherein the central conductor has a diameter between about 0.029 and about 0.035 inches.

14. The device of claim 13, wherein the central conductor has a diameter substantially equal to about 0.032 inches.

15. The device of claim 8, wherein the resistor case comprises an annularly shaped ground plane.

16. The device of claim 15, wherein the outside diameter of the annularly shaped ground plane is greater than 0.280 inches.

17. The device of claim 16, wherein the outside diameter of the annularly shaped ground plane is substantially equal to about 0.281 inches and the inside diameter of the annularly shaped ground plane is substantially equal to about 0.210 inches.

18. The device of claim 8, wherein the resistor case is composed of metal.

19. The device of claim 18, wherein the resistor case is composed of brass and plated with a material selected from the group consisting of nickel and tin.

20. The device of claim 8, wherein the connector body is composed of metal.

21. The device of claim 20, wherein the connector body is composed of brass.

22. The device of claim 8, wherein the connector body is composed of plastic.

23. The device of claim 22, wherein the connector body is composed of a material selected from the group consisting of Ultem and glass-filled polycarbonate.

24. The device of claim 8, wherein the coaxial shell is composed of metal.

25. The device of claim 24, wherein the coaxial shell is composed of brass.

26. The device of claim 8, wherein the coaxial shell is composed of plastic.

27. The device of claim 26, wherein the coaxial shell is composed of a material selected from the group consisting of Ultem and glass-filled polycarbonate.

28. A tamper-resistant device for terminating a connection comprising:

a coaxial shell having a first end and a second end;

a connector body having a first end and a second end, the connector body being dimensioned and configured to be snap fitted within the coaxial shell and including interior threads disposed at the first end of the connector body adjacent the first end of the coaxial shell, the connector body further including two slots in its second end for engagement with a cooperating tool to rotate the connector body with respect to the coaxial shell, such slots extending from the outside of the connector body to the inside of the connector body;

a resistor case having a first end and a second end, the resistor case being dimensioned and configured to be mounted within the connector body;

a resistor mounted within the resistor case for electrical connection through the second end of the coaxial shell; and a sealing member between the connector body and the resistor case, the sealing member disposed proximate a portion of the interior threads opposite the first end of the connector body and gripping at least a portion of the first end of the resistor case.

29. The device of claim 28, wherein the coaxial shell is composed of brass, the connector body is composed of brass, and the resistor case is composed of brass plated with nickel.

30. The device of claim 28 including a tool having a retractable tab for insertion in at least one of such slots.

31. The device of claim 28, wherein the resistor comprises a central conductor with a diameter between about 0.029 and about 0.035 inches.

32. The device of claim 31, wherein the central conductor has a diameter substantially equal to about 0.032 inches.

33. The device of claim 28, wherein the resistor case comprises an annularly shaped ground plane with an outside diameter greater than 0.280 inches.

34. The device of claim 33, wherein the inside diameter of the annularly shaped ground plane is substantially equal to about 0.210 inches.

35. A tamper-resistant device for terminating a connection comprising a coaxial shell having a first end and a second end;

a connector body having a first end and a second end, the connector body being dimensioned and configured to be snap fitted within the coaxial shell and including interior threads disposed at the first end of the connector body adjacent the first end of the coaxial shell, the connector body further including two slots in its second end for engagement with a cooperating tool to rotate the connector body with respect to the coaxial shell, such slots extending from the outside of the connector body to the inside of the connector body;

a resistor case having a first end and a second end, the resistor case being dimensioned and configured to be mounted within the connector body, the resistor case comprising an annularly shaped ground plane with an outside diameter greater than 0.280 inches;

a resistor mounted within the resistor case for electrical connection through the second end of the coaxial shell, the resistor comprising a central conductor and a body, the central conductor having a diameter between about 0.029 and about 0.035 inches; and a sealing member between the connector body and the resistor case, the sealing member disposed proximate a portion of the interior threads opposite the first end of the connector body and gripping at least a portion of the first end of the resistor case.

36. The device of claim 35, wherein the diameter of the central conductor has a diameter substantially equal to about 0.032 inches.

37. The device of claim 35, wherein the inside diameter of the annularly shaped ground plane is substantially equal to about 0.210 inches.

38. The device of claim 35, wherein the coaxial shell is composed of brass, the connector body is composed of brass, and the resistor case is composed of brass plated with nickel.

39. The device of claim 35 including a tool having a retractable tab for insertion in at least one of such slots.

* * * * *